US008388058B2

(12) United States Patent
Krasley

(10) Patent No.: US 8,388,058 B2
(45) Date of Patent: Mar. 5, 2013

(54) DETACHABLE STORAGE RECEPTACLE

(75) Inventor: Christine D. Krasley, Glenmoore, PA (US)

(73) Assignee: Graco Children's Products Inc., Atlanta, GA (US)

( * ) Notice: Subject to any disclaimer, the term of this patent is extended or adjusted under 35 U.S.C. 154(b) by 0 days.

(21) Appl. No.: 13/118,072

(22) Filed: May 27, 2011

(65) Prior Publication Data

US 2012/0299340 A1 Nov. 29, 2012

(51) Int. Cl.
*A47C 7/62* (2006.01)
*A47D 1/10* (2006.01)

(52) U.S. Cl. ..... 297/188.2; 297/250.1; 297/DIG. 6

(58) Field of Classification Search ..... 297/188.2, 297/188.18, 188.06, DIG. 6, 250.1, 188.19; 248/311.2

See application file for complete search history.

(56) References Cited

U.S. PATENT DOCUMENTS

| | | | | |
|---|---|---|---|---|
| 4,286,742 | A | 9/1981 | Pellegrino | |
| 4,379,541 | A * | 4/1983 | Harkness | 248/544 |
| 4,474,354 | A | 10/1984 | Field | |
| 4,511,072 | A | 4/1985 | Owens | |
| 4,566,507 | A | 1/1986 | Rauchwerger | |
| 5,042,770 | A * | 8/1991 | Louthan | 248/311.2 |
| 5,102,086 | A | 4/1992 | Thomason | |
| 5,199,678 | A * | 4/1993 | Luebke | 248/311.2 |
| 5,312,160 | A | 5/1994 | Davis et al. | |
| 5,325,991 | A * | 7/1994 | Williams | 220/739 |
| 5,711,503 | A | 1/1998 | Mitchell | |
| 5,718,405 | A | 2/1998 | Adachi | |
| 5,823,486 | A | 10/1998 | Smith et al. | |
| 5,953,999 | A | 9/1999 | Kanehl | |
| 5,967,345 | A * | 10/1999 | Subotin | 211/119.007 |
| 6,467,839 | B1 * | 10/2002 | Kain | 297/188.14 |
| 6,478,372 | B1 * | 11/2002 | Lemmeyer et al. | 297/188.18 |
| 6,592,180 | B2 | 7/2003 | Combs | |
| 6,629,722 | B1 | 10/2003 | Tang | |
| 6,863,200 | B2 * | 3/2005 | Beglau | 224/482 |
| 7,597,213 | B2 * | 10/2009 | McDonald | 221/46 |
| 2002/0160345 | A1 | 10/2002 | Hempton | |
| 2004/0222345 | A1 | 11/2004 | Lindsay | |
| 2005/0145663 | A1 | 7/2005 | Samuels | |
| 2005/0189806 | A1 * | 9/2005 | Hall et al. | 297/256.11 |
| 2006/0037983 | A1 | 2/2006 | Saxton | |
| 2007/0145700 | A1 | 6/2007 | Ambrose et al. | |
| 2008/0093405 | A1 | 4/2008 | Abe | |
| 2008/0169667 | A1 * | 7/2008 | Siniarski et al. | 296/37.8 |
| 2008/0217370 | A1 | 9/2008 | Shin | |
| 2008/0302840 | A1 | 12/2008 | Missick | |
| 2009/0095765 | A1 | 4/2009 | Guard | |

FOREIGN PATENT DOCUMENTS

| | | |
|---|---|---|
| WO | WO 88/03380 | 5/1988 |
| WO | WO 2007/098546 | 9/2007 |

* cited by examiner

*Primary Examiner* — Milton Nelson, Jr.
(74) *Attorney, Agent, or Firm* — Lempia Summerfield Katz LLC

(57) ABSTRACT

A storage assembly has a panel on a structure and a receptacle with a storage space defined within a body. The panel has an inner surface and an outer surface. A slot is formed through the panel. A tab is attached to and extends from the body of the receptacle and terminates at a free end. A first fastener part is positioned near the slot on the inner surface of the panel and a second fastener part is coupled to the free end of the tab. The tab is extended through the slot and the second fastener part is detachably connected to the first fastener part to attach the receptacle to the panel.

19 Claims, 4 Drawing Sheets

DETACHABLE STORAGE RECEPTACLE

BACKGROUND OF THE INVENTION

1. Field of the Disclosure

The present disclosure is generally directed to storage receptacles, and more particularly to storage receptacles that are attachable to and detachable from a panel on an article of manufacture such as a child seating device or car seat.

2. Description of Related Art

Child seating devices, such as car seats, booster seats, stroller seats, and infant carriers are well known in the art. To provide storage for these devices, portable storage receptacles, such as storage bags, cup holders, trays, or caddies, are often attached to a part of the child seating device. Typically, these storage receptacles are (i) made from a relatively hard yet inexpensive plastic material; and (ii) directly mounted on or to a base frame component of the child seating device or an existing console or arm rest on or near the child seat of the device.

Such storage receptacles, being typically made from a plastic material, can easily be cracked or broken during use, transport, or storage. As a result of how they are attached, such storage receptacles also often project outward from or near the child seating device, leaving them susceptible to damage or unintentional and undesirable removal or detachment. For example, some known storage receptacles have an L-shaped connector that can be placed over the arm rest of the child seating device to attach the storage receptacle to the device. This L-shaped connector, because it is exposed and somewhat bulky, can be bent, broken, or otherwise damaged during installation, use, or storage, rendering it unsuitable for future use. Likewise, this exposed connector can result in an occupant of the child seating device being able to remove the receptacle at inopportune times. By doing so, the occupant can spill or empty the contents of the storage receptacle, which can, depending on the receptacle contents, lead to a mess on or around the child seating device. Removal of the receptacle can also result in damage or destruction to the L-shaped connector, the receptacle, and/or the contents of the receptacle.

SUMMARY

In one example according to the teachings of the present invention, a combination storage assembly and child seating device has a panel on the child seating device and a receptacle with a body, a storage space within the body, and a tab protruding from the body. The panel has an inner surface and an outer surface, and a slot is formed through the panel. A first part of a fastener is coupled to the inner surface near the slot and a second part of the fastener is coupled to a free end of the tab and is configured to connect to the first part. The tab can be inserted through the slot when the body is adjacent the outer surface of the panel. The second part of the fastener can then be connected to the first part on the inner surface of the panel to attach the receptacle to the child seating device. The fastener parts can be detached and the receptacle can be removed from the panel and the device.

In one example, the child seating device can be a car seat with a seat bottom.

In one example, the panel can be on the seat bottom.

In one example, the seat bottom can have a pair of armrests and a seating surface positioned between the pair of armrests. The panel can be on one of the pair of armrests.

In one example, the panel can be a fabric panel.

In one example, the fastener can be a hook and a loop fastener. A first part of the fastener can be a loop patch while the second part of the fastener can be a hook patch.

In one example, the body of the receptacle and the tab can be fabric.

In one example, the body of the receptacle can include a perimeter wall. The tab can be stitched to the perimeter wall.

In one example, the body of the receptacle can include a bottom surface, a sidewall, and an open top.

In one example, the body of the receptacle can include a bottom surface, a sidewall, and an open top. The combination can include a cover for the open top of the receptacle to cover the storage space.

In one example, the body of the receptacle can include a bottom surface, a sidewall, and an open top. The tab can be attached to the sidewall near the open top.

In one example, the fastener can be hidden from view when the receptacle is attached to the child seating device.

In one example, a storage assembly has a panel on a structure and a receptacle with a storage space defined within a body. The panel has an inner surface facing the structure and an outer surface facing away from the structure. A slot is formed through the panel. A flexible tab is attached to and extends from the body of the receptacle and terminates at a free end. A first fastener part is positioned near the slot on the inner surface of the panel and a second fastener part is carried on the free end of the tab. The tab is received through the slot and the second fastener part is removably connected to the first fastener part to secure the receptacle adjacent the outer surface of the panel.

In one example, the receptacle can be a cup holder.

In one example, the receptacle can be a storage pouch with an operable lid.

In one example, the structure can be a seat and the panel can be a fabric panel positioned near the seat.

In one example, the structure can be a child car seat and the panel can be a fabric panel of a soft goods cover on the child car seat.

In one example, the body can have a perimeter wall, a bottom support surface, and an open top.

In one example, the body can have a perimeter wall, a bottom support surface, and an open top. The tab can be affixed to the perimeter wall near the open top.

In one example, the first fastener part can be a loop patch of a hook and loop fastener and the second fastener part can be a hook patch of the hook and loop fastener.

In one example, the first fastener part can be a female snap component and the second fastener part can be a male snap component.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present invention is generally directed to a storage assembly and a combination storage assembly and panel that solves or improves upon one or more of the above noted and/or other problems and disadvantages with prior known storage receptacles. The disclosed storage assembly includes a receptacle and a fastener for attaching the receptacle to a panel, such as one on a child seating device. The fastener is not exposed, but is instead located on an inner surface of the panel near a slot formed through the panel. The hidden or covered fastener retains the receptacle in a position lying against or adjacent the panel and inhibits unintended detachment of the fastener and receptacle during use. Also, the receptacle does not project significantly outward from the panel, thus limiting the exposure of and potential damage to the receptacle during use. The disclosed receptacle can also be made from a flexible fabric material, reducing the likelihood that it will be damaged, bent, or broken during installation, use, storage, and/or transport.

In one example, a combination storage assembly and child seating device is disclosed. The occupant of the child seating device is prevented from accessing the fastener, and thereby detaching the receptacle. The fastener is hidden from view and not exposed when the receptacle is attached to the child seating device. Nonetheless, a non-occupant user is able to release the fastener and detach the receptacle from the child seating device when the user wishes to separately store and/or transport the storage assembly and/or the child seating device. These and other objects, features, and advantages of the disclosed storage receptacle and combination will become apparent upon reading this disclosure.

Figure 1:
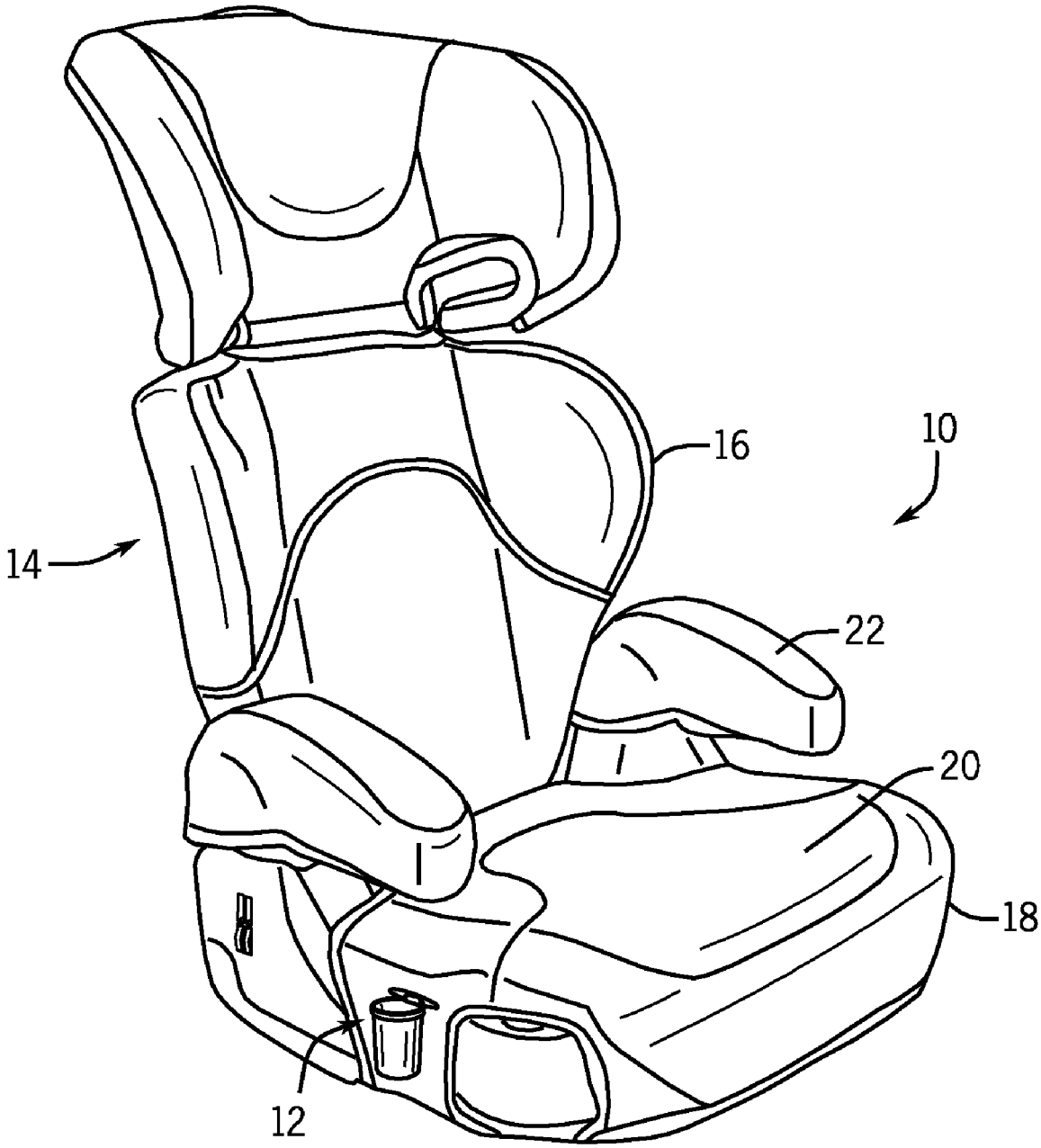
FIG. 1 shows a perspective view of one example of a combination child seating device and storage assembly constructed in accordance with the teachings of the present invention.

Turning now to the drawings, FIG. 1 depicts one example of a combination storage assembly and child seating device 10 constructed in accordance with the teachings of the present invention. In this example, the combination 10 has a storage assembly in the form of a cup holder assembly 12 removably attached to an object, such as a child seating device, which in this example is a child's car or safety seat 14.

One having ordinary skill in the art will come to realize that the present invention is not limited to this particular combination. In other examples, the storage assembly in the combination 10 can be in the form of a pouch (see FIG. 3), bag, caddy, tray, or other receptacle assembly. In other examples, the child seating device in the disclosed combination 10 can be an infant carrier, stroller seat, booster, high chair, vehicle seat, or the like. In other examples, the storage assembly need not be used in combination or connection with the child seating device. Instead, the storage assembly can be used in combination with another object or structure (not shown), such as a car door, table, console, dash board, or the like, that is located near or adjacent a seat. In some instances, the seat can be on a child seating device, such as the car seat 14 described herein. In other instances, the seat can be a standard vehicle seat, patio chair, reclining lounger, or the like.

Figure 2:
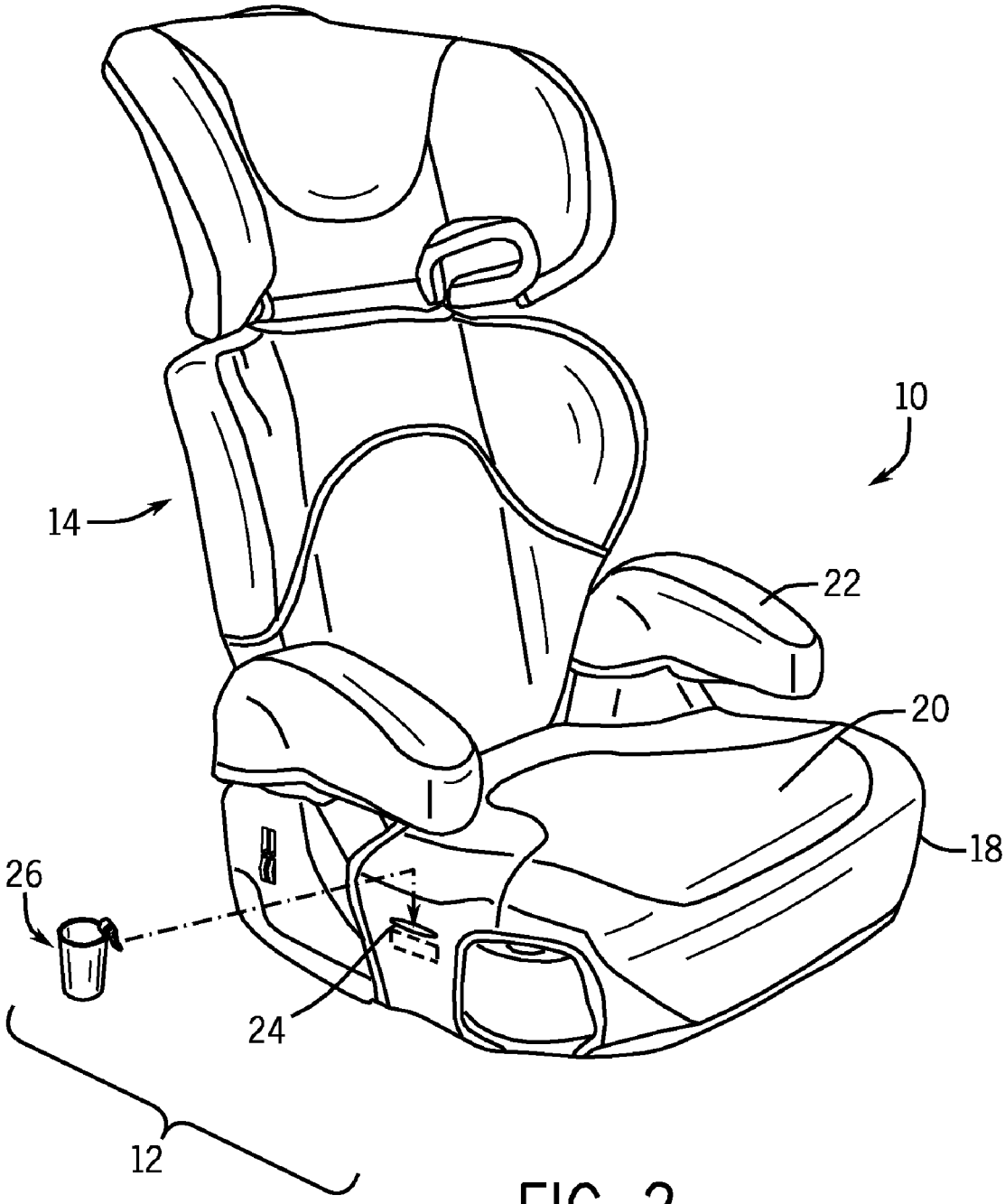
FIG. 2 shows a perspective view of the combination child seating device and storage assembly shown in FIG. 1 with the storage receptacle removed.

FIGS. 1 and 2 show the cup holder assembly 12 and the car seat 14, respectively, attached to (FIG. 1) and detached from (FIG. 2) one another. As is known in the art, the car seat 14 generally includes a seat back 16 coupled to a seat bottom 18. The seat bottom 18 includes a seating surface 20 positioned between a pair of upwardly extending armrests 22. As shown, the cup holder assembly 12 generally includes a slot or groove 24 in a portion of the car seat 14 and a receptacle or cup holder 26.

Figure 3:
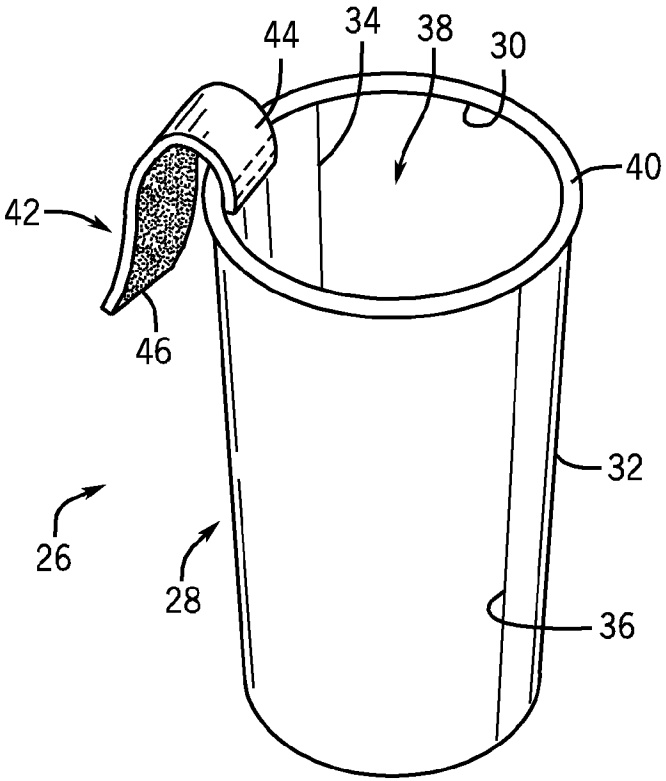
FIG. 3 shows a perspective view of the storage receptacle of the combination shown in FIG. 1.

FIG. 3 shows the receptacle 26 of the combination 10 in greater detail. In this example, the receptacle 26 has a flexible fabric cylindrical body 28 with an open top 30. The body 28 includes a bottom support, which though not specifically depicted herein, can be a solid closed bottom of a fabric, plastic, or other material, or can also be a lattice, grid pattern, or other configuration to support objects within the body 28. The body 28 also includes a cylindrical sidewall or perimeter wall 32 extending upward from the bottom support. The sidewall 32 has an interior surface 34 and an exterior surface 36. Together, the bottom support and the interior surface 34 define a generally cylindrical storage space 38 within the body that is configured to receive and hold cups or containers therein. The sidewall 32 terminates at a top edge 40 that defines the open top 30.

In other examples, though not specifically depicted herein, the receptacle 26 can include a detachable lid, top, or flap to close or cover the open top 30 and enclose the storage space 38. Furthermore, such a lid can be alternatively connected to any part of the body 28, including the interior or exterior surfaces 34, 36, and the top edge 40, using Velcro, snapping components, a zipper, buttons, or the like.

A tab 42 in this example is attached to and protrudes or extends from the body 28. The tab 42 is flexible and can be easily manipulated. The tab 42 can be made of fabric and has an attached end 44 stitched to the body 28. The tab 42 can be stitched to the sidewall 32 in the storage space 38 of the receptacle. More particularly, the tab 42 is stitched to the interior surface 34 of the sidewall 46 near the open top 30 just below the top edge 40. From the attached end 44, the tab 42 protrudes from the body 28 over the top edge 40 and loops downward and away from the body. Tab 42 terminates at a free end 46 that can hang freely away from the body 28 and at a lower elevation than the edge 40.

One of ordinary skill in the art will come to recognize that the tab 42 can be attached or connected to different parts of the body 28. For example, the tab 42 can be directly attached to the top edge 40 or to the exterior surface 36 of the sidewall 32. Moreover, the tab 42 need not be stitched to the body 28, as the tab 42 can instead be glued, latched, or otherwise secured or fastened to the body in another manner. The tab 42 can also be formed as an integral, one-piece extension of the material of the body 28.

Figure 4:
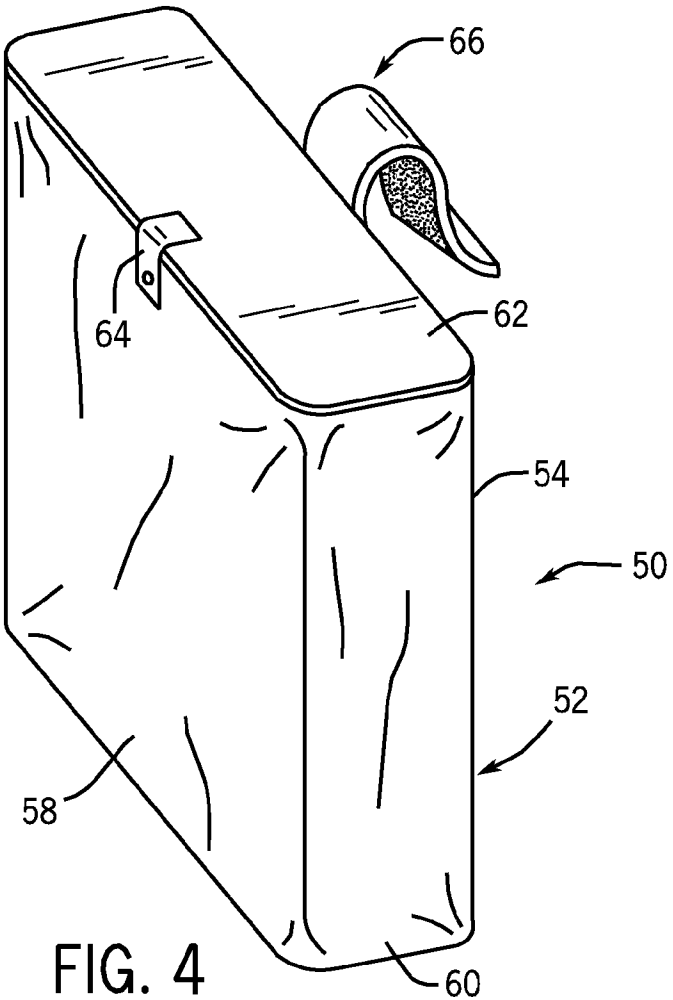
FIG. 4 shows a perspective view of another example of a storage receptacle constructed in accordance with the teachings of the present invention.

FIG. 4 shows an alternate example of a receptacle or storage pouch 50 constructed in accordance with the teachings of the present invention. In this example, the receptacle 50 has a flexible fabric rectangular body 52. The body 52 includes a rectangular bottom support (not shown) and a four-sided sidewall or perimeter wall 54 extending upward from the bottom support. The sidewall 54 has a pair of opposed sides 58 and a pair of opposed ends 60. The sidewall 54 terminates at a top edge (not shown). Together, the bottom support, the pair of sides 58, and the pair of ends 60 define a rectangular storage space (not shown) within the body 52 configured to receive and hold objects. The receptacle 50 in this example further includes a lid 62 that covers the storage space at the top edge. The lid 62 has a closure 64 for securing the lid in the closed position as shown. In this example, the receptacle 50 also includes a tab 66, similar to the previously described tab 42, attached to and protruding or extending from the body 52.

In the examples shown in FIGS. 3 and 4, the receptacles 30, 50 and the tabs 42, 66 can be manufactured using a flexible fabric material. In other examples, one or more of the receptacles 30, 50 and the tabs 42, 66 can be made of plastic, nylon, cotton, leather, man-made textile, or even a somewhat rigid material. Likewise, each of the receptacles 30, 50 can, in other examples, be sized or shaped differently to accommodate and store different items in the defined storage space. For example, the receptacles 30 and 50 can have a triangular, square, or irregular shape. The tabs 42 and 66 can also have a different size or shape than the tabs depicted and described herein. For example, the tabs 42 and 66 can have a different shape such as being square, triangular, or the like, and/or can have a different size, such as being longer, wider, narrower, or the like, than the tabs described herein.

Figure 5:
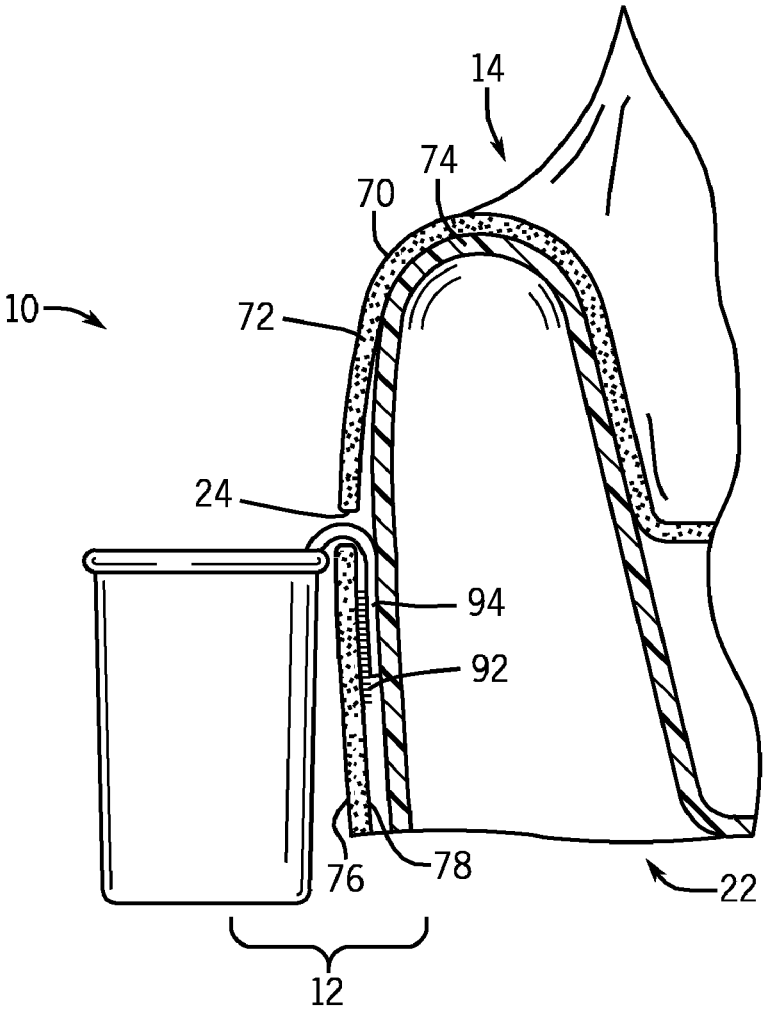
FIG. 5 shows a cut away section view of the combination child seating device and storage assembly shown in FIG. 1.

FIG. 5 illustrates, in greater detail, the attachment of the cup holder assembly 12 to the car seat 14. In this example, the car seat 14 has a panel 70. The panel 70 in this example, as shown in FIG. 5, is part of a fabric seat pad or soft goods cover 72 installed over a seat shell 74 of the car seat 14. The fabric panel 70 has an outer surface 76 and an inner or inward facing surface 78. The outer surface 76 faces outward and is exposed. The inner surface 78 in this example faces inward and contacts or touches the seat shell 74.

In other examples, the panel 70 can be a different part of the car seat 14. The panel 70 also need not be or function as a seat pad or soft goods cover for the car seat 14. Instead, the panel 70 can be placed onto or over some part or all of an existing seat pad or soft goods cover of the car seat 14, with the sole purpose of providing an attachment area for the storage assembly or cup holder assembly 12. Since the cup holder assembly 12 can be used in combination or connection with other child seating devices or structures, as described above, the panel 70 can, in other examples, be positioned on, over, or be part of one of these alternative child seating devices or structures. The panel 70 can alternatively be part of the seat shell 74.

The panel 70 also does not have to be made of a fabric material. In other examples, the panel 70 can be created using plastic, leather, metal, man-made textiles, or the like. The panel 70 can also be made of a different material, not explicitly disclosed herein, if, for example, the car seat 14 or the other child seating devices and structures are constructed from a different material. One having ordinary skill in the art will also come to recognize that the panel 70 can have a different size, shape, contour, and/or thickness than the disclosed panel.

In this example, the slot 24 is formed through the fabric panel 70 on one of the pair of armrests 22 of the car seat 14. As shown in FIG. 5, the slot 24 is an oval-shaped aperture or opening 92 through the panel 70. In other examples, the slot 24 can have a different size and shape and/or be positioned in a different location on the panel 70 or, more generally, the car seat 14. For example, the slot 24 can be formed through the fabric panel 70 on the other of the pair of armrests 22, behind the seat back 16, or on a side of the seat bottom 18 below the armrests.

As shown in FIG. 5, the cup holder assembly 12 in this example further includes a fastener 90 to secure the cup holder assembly to the seat 14. The fastener 90 in this example includes a first fastener part 92 and a second fastener part 94. The first part 92 is affixed to the inner surface 78 of the panel 70 near and below the slot 24. The second part 94 is affixed to the tab 42, particularly the free end 46 of the tab, as shown. In the disclosed example, the fastener 90 is a VELCRO or other hook and loop fastener with the first fastener part 92 being a loop patch and the second fastener part 94 being a hook patch.

In another example, the first fastener part 92 can be the hook patch and the second fastener part 94 can be the loop patch of the hook and loop fastener 90. In other examples, the cup holder assembly 12, or any other storage assembly, can include a snap, button, latch, catch, or other type of fastener instead of the hook and loop fastener 90 described herein. For example, the first and second fastener parts 92, 94 can instead be in the form of a female and male snap component, respectively. One having ordinary skill in the art will also come to recognize that the first fastener part 92 can be connected to or otherwise retained by the inner surface 78 of the panel 70 in a different manner and that the second fastener part 94 can be connected to the free end 46 of the tab 42 in a different manner and can also be positioned on or coupled to another portion of the tab. The hook and loop patches in this example are stitched to the panel and the body, respectively. The fastener parts 92, 94 can alternatively be riveted, taped, glued, or otherwise adhered to their respective surfaces.

With reference back to FIG. 2, prior to attachment, the receptacle 26, particularly the body 28, is placed adjacent or near the panel 70, particularly the outer surface 76. The free end 46 of the tab 42 can then be inserted into and through the slot 24. The free end 46 and the first part 92, which is affixed to the free end, slide through the slot 24 and then down toward the second part 94 between the inner surface 78 of the panel 70 and the seat shell 74. Once the first part 92 is near or adjacent the second part 94, the two fastener parts 92, 94 can be engaged with or connected to one another as shown in FIG. 5.

This engagement or connection attaches and secures the receptacle 26 to the car seat 14. In this position, the receptacle 26, and, more specifically, the body 28 of the receptacle, is secured adjacent the outer surface 76 of the panel 70 in a generally vertical position parallel to the outer surface 76. As best shown in FIG. 1, the fastener 90, which in this example includes the two fastener parts 92, 94, is hidden from view when the receptacle 26 is attached to the car seat 14.

When removal is desired, the receptacle 26 is detachable from the car seat 14. This process entails placing a finger through the slot 24 and between the two fastener parts 92, 94 to disengage the fastener 90. In this example, this requires removing the hook patch, and more generally the tab 42, from the loop patch. Alternatively, the user can reach under the panel 70 from below the slot 24 to disengage the fastener 90. In either case, the receptacle 26 is released and can be moved away from the seat 14, withdrawing the tab 42 from the slot 24 in the panel 70. In some examples, the panel 70 can also be detached or detachable from the car seat 14, the child seating device, or the structure. Either way, the detachable nature of at least some parts of the cup holder assembly 12 is beneficial to a user who wishes to easily and separately transport and/or store various components of the combination 10.

Figure 6:
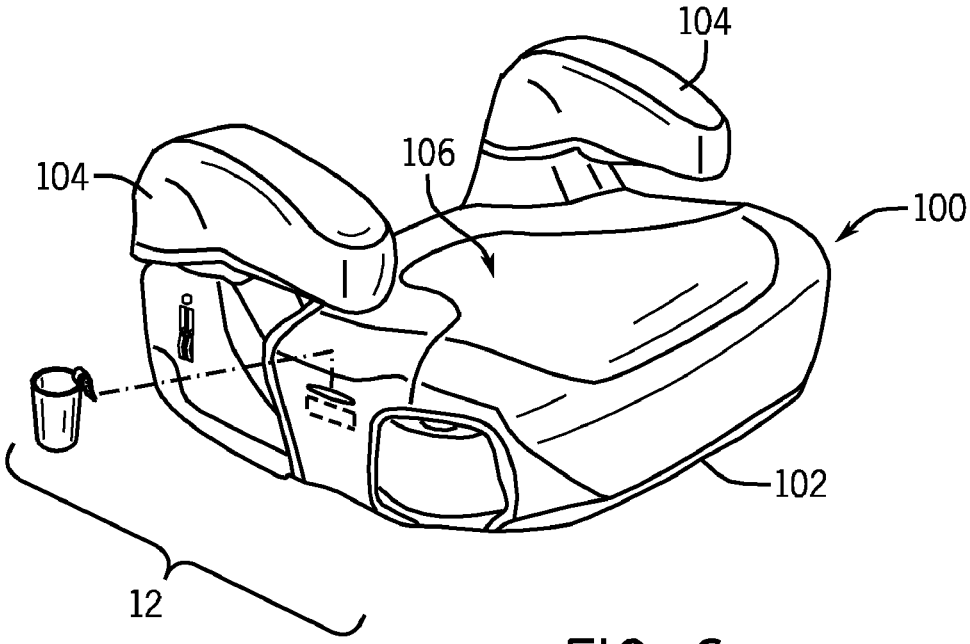
FIG. 6 shows a perspective view of another example of a combination child seating device and storage assembly constructed in accordance with the teachings of the present invention.

As noted above, the cup holder assembly 12 can also be used in combination with an alternative child seating device, such as a booster seat 100. FIG. 6 shows the cup holder assembly 12 detached from the booster seat 100. The booster seat 100 generally includes a seat base 102, a pair of curved armrests 104 extending upward from the seat base 102, and a seating surface 106 on a top side of the seat base 102 between the armrests 104.

Though not specifically depicted herein, an alternative combination can include two cup holder assemblies 12 with the car seat 14. In such an example, the combination would include two slots 24 (one on each side of the car seat 14), two receptacles 26, and two fasteners 90. Using the fasteners 90 as described above, one receptacle 26 can be securedly retained by the respective slot 24 on each side of the car seat 14, thereby providing a seat occupant with two cup holders and/or storage receptacles. As with the combination 10, such an alternate combination is not limited by the specific examples herein but can include two cup holder assemblies 12 with other child seating devices or structures. Likewise, the alternate combination can include two alternate storage assemblies instead of the two cup holder assemblies 12, or one of each type.

Although a storage assembly and a combination child seating device and storage assembly have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A combination storage assembly and child seating device comprising:

a panel on the child seating device having an inner surface and an outer surface;

a slot formed through the panel;

a first part of a fastener coupled to the inner surface near the slot;

a receptacle having a body, a storage space within the body, and a tab protruding from the body; and a second part of the fastener coupled to a free end of the tab and configured to connect to the first part, wherein the tab is extended through the slot with the body adjacent the outer surface of the panel, and wherein the second part is detachably connected to the first part on the inner surface of the panel attaching the receptacle to the child seating device.

2. The combination of claim 1, wherein the child seating device is a car seat with a seat bottom.

3. The combination of claim 2, wherein the panel is on the seat bottom.

4. The combination of claim 2, wherein the seat bottom comprises a pair of armrests and a seating surface positioned between the pair of armrests, and wherein the panel is on one of the pair of armrests.

5. The combination of claim 1, wherein the panel is a fabric panel.

6. The combination of claim 1, wherein the fastener comprises a hook and a loop fastener, and wherein the first part of the fastener is a loop patch and the second part of the fastener is a hook patch.

7. The combination of claim 1, wherein the body of the receptacle and the tab are fabric.

8. The combination of claim 1, wherein the body of the receptacle includes a perimeter wall and the tab is stitched to the perimeter wall.

9. The combination of claim 1, wherein the body of the receptacle comprises a bottom surface, a sidewall, and an open top.

10. The combination of claim 9, further comprising a cover for the open top of the receptacle to cover the storage space.

11. The combination of claim 9, wherein the tab is attached to the sidewall near the open top.

12. A storage receptacle assembly comprising:

a fabric panel positioned near a seat and having an inner surface facing the structure and an outer surface facing away from the seat;

a slot formed through the fabric panel;

a first fastener part positioned near the slot on the inner surface of the fabric panel;

a receptacle having a storage space defined within a body; and a flexible tab attached to the body of the receptacle and extending therefrom, the flexible tab terminating at a free end; and a second fastener part carried on the free end of the tab, wherein the tab is received through the slot and the second fastener part is removably connected to the first fastener part, such that the receptacle is secured adjacent the outer surface of the fabric panel.

13. The storage receptacle assembly of claim 12, wherein the receptacle is a cup holder.

14. The storage receptacle assembly of claim 12, wherein the receptacle is a storage pouch with an operable lid.

15. The storage receptacle assembly of claim 12, wherein the first fastener part is a female snap component and the second fastener part is a male snap component.

16. The storage receptacle assembly of claim 12, wherein the seat is a child car seat and the fabric panel is part of a soft goods cover on the child car seat.

17. The storage receptacle assembly of claim 12, wherein the body has a perimeter wall, a bottom support surface, and an open top.

18. The storage receptacle assembly of claim 17, wherein the tab is affixed to the perimeter wall near the open top.

19. A storage receptacle assembly comprising:

a panel on a structure having an inner surface facing the structure and an outer surface facing away from the structure;

a slot formed through the panel;

a first fastener part positioned near the slot on the inner surface of the panel;

a receptacle having a storage space defined within a body; and a flexible tab attached to the body of the receptacle and extending therefrom, the flexible tab terminating at a free end; and a second fastener part carried on the free end of the tab, wherein the tab is received through the slot and the second fastener part is removably connected to the first fastener part, such that the receptacle is secured adjacent the outer surface of the panel, and wherein the first fastener part is a loop patch of a hook and loop fastener and the second fastener part is a hook patch of the hook and loop fastener.

* * * * *